United States Patent [19]

Risman

[11] 4,011,427

[45] Mar. 8, 1977

[54] ELECTRIC SUPPLY CIRCUITS FOR A MICROWAVE OVEN

[75] Inventor: Per Olov G. Risman, Huskvarna, Sweden

[73] Assignee: Husqvarna Vapenfabriks AB, Huskvarna, Sweden

[22] Filed: Feb. 13, 1975

[21] Appl. No.: 549,739

Related U.S. Application Data

[63] Continuation of Ser. No. 401,558, Sept. 27, 1973, abandoned.

[30] Foreign Application Priority Data

Sept. 27, 1972 Sweden ..... 12448/72

[52] U.S. Cl. ..... 219/10.55 B

[51] Int. Cl.[2] ..... H05B 9/06

[58] Field of Search ..... 219/10.55 B; 331/86; 328/270; 315/104, 106

[56] References Cited

UNITED STATES PATENTS

| | | | |
|---|---|---|---|
| 3,396,342 | 8/1968 | Feinberg | 219/10.55 B |
| 3,398,371 | 8/1968 | Lamb | 219/10.55 B |
| 3,591,826 | 7/1971 | Valles | 219/10.55 B |
| 3,752,948 | 8/1973 | Peterson | 219/10.55 B |
| 3,821,594 | 6/1974 | Webb et al. | 315/104 |

*Primary Examiner*—Bruce A. Reynolds
*Attorney, Agent, or Firm*—Holman & Stern

[57] ABSTRACT

An electric supply circuit for a microwave oven provided with a magnetron tube in which an anode circuit is supplied with high tension, the circuit comprising a mains supply, a leak field transformer having a primary winding and a secondary winding, the secondary winding supplying the anode circuit, two parallel branches connecting the primary winding of the transformer to the mains supply, a first one of the two branches including a switch and a protective resistor serially connected, a second one of the two branches including a relay contact, and a relay coil being connected in series to the protective resistor and forming an additional branch which is connected in parallel to the primary winding of the transformer, the relay coil controlling the relay contact, the first one of the branches being closed upon actuation of the switch supplying the relay coil and the primary winding via the protective resistor, the second one of the branches being closed upon exitation of the relay coil to close the relay contact.

1 Claim, 1 Drawing Figure

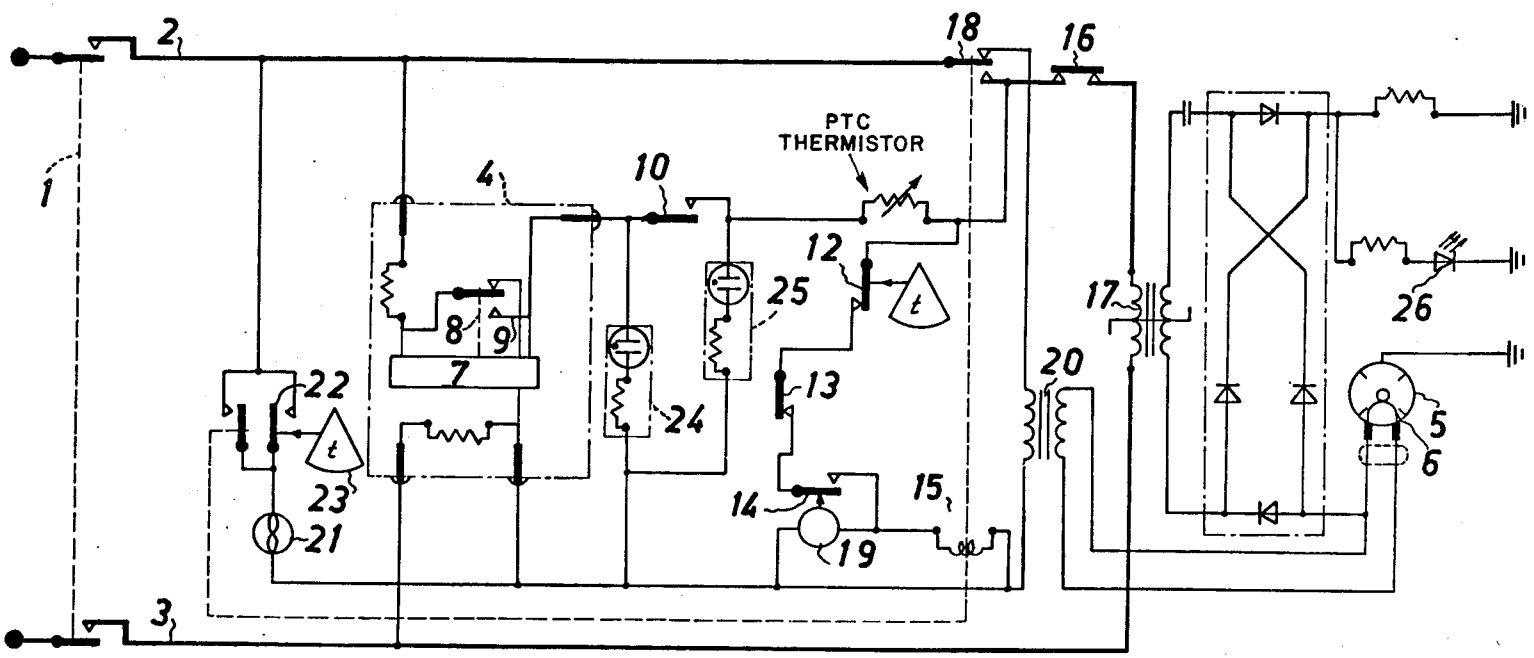
PTC
THERMISTOR

ELECTRIC SUPPLY CIRCUITS FOR A MICROWAVE OVEN

This is a continuation of application Ser. No. 401,558 filed Sept. 27, 1973, abandoned.

BACKGROUND OF THE INVENTION

The present invention relates to a circuit arrangement for starting a microwave oven provided with a leak field transformer. When startng such an oven, it is generally known that a large transient current flows through the supply circuits.

The transient current causes stresses on the circuits and should be eliminated. A solution of this problem in the prior art has been a current limitation arrangement associated with the starting of the oven. As a startiing knob is turned from zero to a starting position, a protective resistor is connected into a transformer circuit so that the current is limited. This arrangement is, however, not safe, since there is a risk of burning the resistor. Another solution known in the prior art is the arrangement of two relys in such a way that one relay switches on before the other and a resistor is connected into the transformer circuit just during the interval between the switchings of the relays. The relays make the arrangement expensive so it would be advantageous to eliminate one of them, if possible. The use of one over-dimensioned contactor could solve this problem, and would switch on the transformer, but that solution is economically disadvantageous space consuming and improper with regard to the noise of the contactor.

SUMMARY OF THE INVENTION

The present invention relates to a circuitry by which the above mentioned drawbacks are eliminated and a safe current pulse limitation is obtained. The mode of operation of the circuitry is based on the switching in of a leak field transformer in two steps and thus avoiding transient peak currents when the oven is started. This operation is obtained by using only one non-expensive, silient relay without any extra relay contacts. According to the invention the problem is solved by a supply circuit of a transformer including two parallel branches, one of which comprises a relay contact and the other of which comprises a protective resistor; a relay guiding the relay contact is connected to the resistor branch which is short-circuited by the relay contact when the relay functions.

BRIEF DESCRIPTION OF THE DRAWING

A circuit arrangement according to the invention is described in the following with references to the accompanying drawing showing the arrangement in a circuit diagram.

DETAILED DESCRIPTION OF THE PREFERRED EMBODIMENT

The circuit shown in the drawing constitutes the electric equipment of a microwave oven and its mode of operation is as follows. The oven is connectable to a mains supply by means of a main switch 1 through which the mains voltage is conducted to wires 2 and 3. A delay unit 4 is provided for the purpose of preventing a magnetron 5 of the oven to be switched on before its cathode 6 has reached a sufficiently high temperature. A delay circuit denoted 7 included in this unit actuates after a predetermined period (the heating period of the cathode from switching the main switch 1 on a relay contact 8 to a self-holding contact 9 providing a voltage to a start contact 10. When this contact is closed, the voltage will pass, on one hand, through a branch including a resistor 11 and switches 12, 13 and 14 to a relay coil 15, and on the other, through another branch including a switch 16 in series with a high voltage transformer 17 of the leakage reactance or leak field kind. A current will pass through the start contact 10 and the resistor 11 for a period equal to the time consumed by the relay 15 for changing over (about 0.1 s). This short current period is important because it is exciting the core of the transformer 17 in such a way that the transient current through the primary winding of the transformer does not reach an abnormal magnitude, when switch 18 is changed over by the relay coil 15 to supply the transformer directly from the mains. When changing over the switch 18 a holding current will pass through the relay coil via the switches 12, 13, 14 to keep the relay coil excited. An electric timer 19 is supplied through the same way.

The timer operates the switch 14 which is opened when a working time period not on the timer has passed, whereby the relay 15 falls, and the supply via the switch 18 of the transformer 17 is interrupted. The switch 16 is a safety switch which is opened, when the oven door is opened, interrupting the supply if the door is opened during the operation of the oven. The switch 13 has a similar function (double breaking) in the control circuit of the relay 15.

An oven-temperature protector is arranged to sense the temperature of the magnetron and to actuate the switch 12 if this temperature becomes too high. The switch 18 is a change-over switch which in the shown position closes a circuit through another transformer 20, which supplies the cathode of the magnetron.

A fan 21 is provided to cool the magnetron and is supplied in a circuit connected to the wires 2 and 3 and controlled by a thermostat 23 sensing the temperature of the magnetron and actuating a switch 22 in the circuit.

The start switch 10 does not conduct the full working current from the mains to the transformer 17, as it only works during the starting sequence. This working current exceeds usually 5 A. The circuitry hereinbefore described is therefore usable also in other equipment in which large transformers are switched on and off frequently.

The protection resistor 11 may advantageously be a PTC-thermistor. On the occasion of a fault in the relay coil 15 the thermistor is heated rapidly, when the start contact 10 is closed, but reaches only about 80° C as the resistance rapidly increases due to the temperature rising. After half a second the current is only a few mA, and the voltage in the primary winding of the transformer 17 is small. The thermistor is thus not damaged by occasional faults in the circuits, so wires and components in the vicinity do not become too hot. If the output of the transformer 17 is short-circuited, the voltage drop in the thermistor (normally about 40 V) becomes so great that the relay 15 is not excited. This is an essential safety requirement, because the relay then cannot switch on excessive currents due to faults in the transformer, relay contacts and wires. If the oven is started too frequently, the relay contacts may be overheated. This is no risk in the circuitry described since the oven cannot get started more than 6 or 7 times per minute, because the thermistor is heated a little during every start sequence and if it gets too hot, it will prevent the excitation of the relay 15 and has to cool down for about 30 seconds, before the oven can get started again.

The circuitry described can be provided with several control arrangements. The accompanying diagram shows two glow lamps 24, 25 of which the first one is intended to indicate that the supply voltage reaches the start contact 10 and the other to indicate that the associated circuits get a voltage. Another control arrangement is constituted of a light emitting diode 26 in the anode circuit of the magnetron. A current proportional to the anode current passes the light emitting diode whose level of brightness is a function of the current passing through, whereby an indication of the relative magnitude of the anode current is obtained.

The circuitry now described is based on properties of a PTC-thermistor which are per se known but offer a combination of advantages in this circuitry and similar circuit arrangements which otherwise could be obtained only by using circuits including essentially more components than hereinbefore described.

What is claimed is:

1. An electric supply circuit for a microwave oven provided with a magnetron tube in which an anode circuit is supplied with high voltage, said circuit comprising in combination; a main power supply; a leakage reactance transformer having a primary winding and a secondary winding; said secondary winding supplying said anode circuit; two parallel circuits connecting said primary winding of said transformer to said main power supply, a first one of said two circuits including a switch and a protective resistor serially connected, said protective resistor comprising a thermistor having a positive temperature constant; a second one of said two circuits including a relay contact; and a relay coil connected in series to said protective resistor and forming an additional circuit which is connected in parallel to said primary winding of said transformer, said relay coil controlling said relay contact, said first one of said circuits being energized upon actuation of said switch supplying said relay coil and said primary winding through said protective resistor, said second one of said circuits being energized upon actuation of said relay coil to close said relay contact.

* * * * *